United States Patent [19]

Ferm

[11] 4,431,514

[45] Feb. 14, 1984

[54] HEAT EXCHANGER ANTIFOULANT

[75] Inventor: Richard L. Ferm, Lafayette, Calif.

[73] Assignee: Chevron Research Company, San Francisco, Calif.

[21] Appl. No.: 344,139

[22] Filed: Jan. 29, 1982

[51] Int. Cl.[3] ..... C10G 9/16

[52] U.S. Cl. ..... 208/48 AA; 252/51.5 A

[58] Field of Search ..... 208/48 AA; 252/51.5 A

[56] References Cited

U.S. PATENT DOCUMENTS

| | | | |
|---|---|---|---|
| 2,403,293 | 7/1946 | Miskel | 252/51.5 A |
| 2,598,213 | 5/1952 | Blair | 252/51.5 A |
| 2,736,658 | 2/1956 | Pfohl | 252/51.5 A |
| 3,110,673 | 11/1963 | Benoit | 252/51.5 A |
| 3,116,252 | 12/1963 | Beretvas | 252/51.5 A |
| 3,259,578 | 7/1966 | Dickson | 252/51.5 A |
| 3,364,130 | 1/1968 | Barnum et al. | 208/48 AA |
| 3,567,623 | 3/1971 | Hagney | 208/48 AA |
| 3,776,835 | 12/1973 | Dvoracek | 208/48 AA |
| 4,024,051 | 5/1977 | Shell et al. | 208/48 AA |
| 4,200,518 | 4/1980 | Mulvany | 208/48 AA |

*Primary Examiner*—Delbert E. Gantz
*Assistant Examiner*—Cynthia A. Prezlock
*Attorney, Agent, or Firm*—D. A. Newell; J. M. Whitney; J. J. DeYoung

[57] ABSTRACT

Disclosed is a process for reducing the fouling in a heat exchanger in which a hydrocarbon stream is heated or cooled as it passes through the heat exchanger. From 1 to 500 parts per million of the reaction product of a polyalkylene amine and a hydroxy fatty acid are added to the stream to reduce fouling.

9 Claims, No Drawings

HEAT EXCHANGER ANTIFOULANT

BACKGROUND OF THE INVENTION

The invention relates to heat exchangers, particularly heat exchangers used in the processing of crude oil. More particularly, the invention relates to an additive for reducing heat exchanger fouling.

In the processing of petroleum, numerous heat exchangers are utilized to heat or cool process streams. Since refineries typically process very large quantities of petroleum ranging from 25,000 to 200,000 or more barrels per day, the heat exchangers in the refinery represent a very large capital investment. After a period of operation, deposits build up on the heat exchanger tubes greatly reducing heat exchanger efficiency and greatly increasing the energy consumed. Eventually, the heat exchanger must be taken out of operation and the tubes cleaned or replaced. Increasing heat exchanger efficiency and reducing the amount and rate of fouling can provide tremendous energy savings in refineries and other facilities that use heat exchangers.

DESCRIPTION OF THE PRIOR ART

U.S. Pat. No. 4,200,518 claims the use of 1 to 500 parts per million of a polyalkylene amine in a liquid hydrocarbon stream to reduce heat exchanger fouling.

SUMMARY OF THE INVENTION

A process for reducing heat exchanger fouling in which a liquid hydrocarbon stream is passed through a heat exchanger at a temperature from 0° to 1500° F. wherein from 1 to 500 parts per million of an antifoulant additive is added to said hydrocarbon stream, said additive comprising the reaction product of a polyalkylene amine and a hydroxy fatty acid.

DETAILED DESCRIPTION OF THE INVENTION

The present invention is an improvement over the invention disclosed in the aforementioned U.S. Pat. No. 4,200,518, the entire disclosure of which is incorporated herein by reference.

The heat exchangers utilized in the present invention are of any type where deposits accumulate on a heat transfer surface. The most common type of heat exchanger used is commonly known as a shell and tube heat exchanger.

The hydrocarbon stream passing through the heat exchanger is preferably a crude oil stream. However, any hydrocarbon stream which leads to fouling of the heat exchanger can be utilized in the present invention, particularly various fractions of the crude oil. Generally, the streams passing through the heat exchanger will be heated or cooled at temperatures ranging from 0° to 1500° F., preferably 50° to 800° F.

The antifouling additive of the present invention comprises the reaction product of polyalkylene amines and a hydroxy fatty acid.

THE POLYALKYLENE AMINES

The polyalkylene amines which are suitable are commercially available materials and have been used in automotive fuels for their detergent or dispersant properties. See, for example, U.S. Pat. Nos. 3,898,056, 3,438,757 and 4,022,589 for representative polyalkylene amines and methods of manufacture. The disclosures of these three patents are incorporated herein by reference.

As used in the present application, the term "polyalkylene amine" includes monoamines and polyamines.

The polyalkylene amines are readily prepared by halogenating a relatively low molecular weight polyalkylene, such as polyisobutylene, followed by a reaction with a suitable amine such as ethylenediamine.

The polyalkylene may be prepared by ionic or free-radical polymerization of olefins having from 2 to 6 carbon atoms (ethylene must be copolymerized with another olefin) to an olefin of the desired molecular weight. Suitable olefins include ethylene, propylene, isobutylene, 1-butene, 1-pentene, 3-methyl-1-pentene, 4-methyl-1-pentene, etc. Propylene and isobutylene are most preferred.

The alkylene radical may have from 2 to 6 carbon atoms, and more usually from 2 to 4 carbon atoms. The alkylene group may be straight or branched chain.

The amines are selected from hydrocarbylamines, alkoxy-substituted hydrocarbylamines, and alkylene polyamines. Specific examples of hydrocarbylamines include methylamine, propylamine, butylamine, pentylamine, hexylamine, heptylamine, octylamine, di-n-butylamine, di-n-hexylamine, decylamine, dodecylamine, hexadecylamine, octadecylamine, etc. Specific examples of alkoxy-substituted hydrocarbyl amines include methoxyethylamine, butoxyhexylamine, propoxypropylamine, heptoxyethylamine, etc., as well as the poly(alkoxy)amines such as poly(ethoxy)ethylamine, poly(propoxy)ethylamine, poly(propoxy)-propylamine and the like.

Suitable examples of alkylene polyamines include, for the most part, alkylene polyamines conforming to the formula $$H-\underset{\underset{R^1}{|}}{N}-(\text{Alkylene}-\underset{\underset{R^1}{|}}{N})_n-R^1$$

wherein (A) n is an integer at least 1 and preferably less than about 10; (B) each $R^1$ independently represents hydrogen or a substantially saturated hydrocarbon radical; and (C) each alkylene radical can be the same or different and is preferably a lower alkylene radical having 8 or less carbon atoms, and when alkylene represents ethylene, the two $R^1$ groups or adjacent nitrogen atoms may be taken together to form an ethylene group, thus forming a piperazine ring.

In a preferred embodiment, $R^1$ represents hydrogen, methyl or ethyl. The alkylene amines include principally methylene amines, ethylene amines, propylene amines, butylene amines, pentylene amines, hexylene amines, heptylene amines, octylene amines, other polymethylene amines, and also the cyclic and the higher homologs of such amines such as piperazines and amino-alkyl-substituted piperazines. These amines are exemplified specifically by: ethylene diamine, diethylene triamine, triethylene tetramine, propylene diamine, octamethylene diamine, di(heptamethylene) triamine, tripropylene, tetramine, tetraethylene pentamine, trimethylene diamine, pentaethylene hexamine, di(trimethylene) triamine, 2-heptyl-3-(2-aminopropyl)imidazoline, 4-methylimidazoline, 1,3-bis(2-aminoethyl)imidazoline, 1-2(2-aminopropyl)piperazine, 1,4-bis(2-aminoethyl)piperazine, and 2-methyl-1-(2-aminobutyl)piperazine. Higher homologs such as are obtained by condensing two or more of the above-illustrated alkylene amines likewise are useful.

The polyalkylene amine will generally have an average molecular weight in the range of 200 to 2700, preferably 800 to 1500 and will have been reacted with sufficient amine to contain from 0.8 to 7.0, preferably 0.8 to 1.2 weight percent basic nitrogen.

THE HYDROXY FATTY ACIDS

Hydroxy fatty acids generally containing 2 to 5 carbon atoms are useful for reaction with the above polyalkylene amines to form the antifouling additive of the present invention. Representative hydroxy fatty acids include: glycolic acid, 2-hydroxy propionic acid, 1-hydroxy propionic acid, 1-hydroxy butanoic acid, 5-hydroxy pentanoic acid, etc. Preferred is glycolic acid.

THE REACTION AND REACTION PRODUCT

The additive of the present invention can be formed by reacting the above-described polyalkylene amine with the hydroxy fatty acid under reaction conditions including a temperature in the range 100° to 200° C. Preferably roughly equimolar amounts of the polyalkylene amine and acid are reacted and the water of reaction is removed by azeotropic distillation with toluene.

The reaction product is believed to be a complex reaction mixture primarily comprising amides and imidazolines with the following equation representing many of the products which could be present in the reaction mixture:

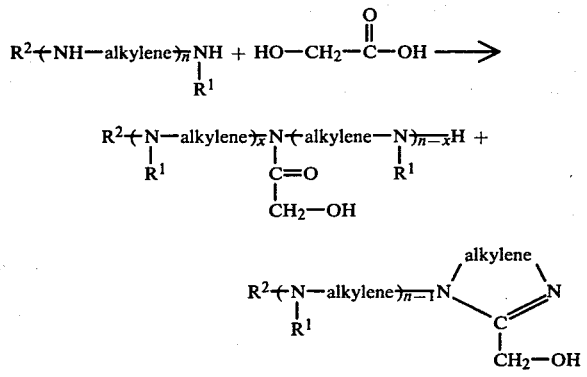

where $R^1$, and n are as defined before and $R^2$ is a polyalkylene group, preferably polybutene, and x is an integer from 0 to n−1.

To substantially reduce heat exchanger fouling, an effective amount, generally from 1 to 500 parts per million, preferably 5 to 99 parts per million, and most preferably 10 to 49 parts per million of the above-described polyalkylene amine is added to the stream passing through the heat exchanger. One surprising feature of the present invention resides in the finding that such small quantities of the above-described additive are effective in reducing the heat exchanger fouling.

EXAMPLE 1

To a 500 ml round bottom flask equipped with a thermometer, stirrer and condenser with a Dean & Stark trap was added 246.07 grams of a polybutene amine having a molecular weight of about 1000, 24 ml toluene and 16.3 grams of 70% active glycolic acid. The reaction mixture was heated to approximately 100° C., and then to a reflux temperature of 165° to 178° C. and allowed to reflux until all the water of reaction was collected in the trap. 6.6 ml of water was collected after 13 hours. The product material was then cooled and weighted (238.99 grams).

EXAMPLES 2–4

Antifouling Tests

The polybutene amine reactant and the reaction product produced in Example 1 were tested for their antifouling characteristics using a standard ALCOR Test Apparatus. This test involves feeding a test stock material at a fixed rate and for a fixed period of time and at constant inlet temperature into a tube containing a stainless steel electrically heated rod while supplying enough heat to the rod to maintain the outlet temperature of the test stock constant. As fouling deposits form on the rod, the temperature of the rod must be increased to maintain a constant outlet temperature of the test stock. The initial rod temperature and final rod temperature are measured along with the initial and final weight of the rod. The increase in rod temperature and the amount of deposits on the rod are indicative of the degree and rate of fouling.

Three tests runs for 3 hours each were made using a Rangely Crude as the test stock. In the first test no antifouling additive was used. In the second test 50 ppm of the polybutene amine referred to in Example 1 was added to the test stock. In the third test 50 ppm of the polybutene-glycolic acid reaction product of Example 1 was added to the test stock. The results are shown below in Table I.

TABLE I

| Additive | Heater Rod Temperature Increase (°F.) | Fouling Deposit (mg) |
|---|---|---|
| None | 25 | 2.5 |
| Polybutene amine | 4 | 2.0 |
| Example 1 product | 2 | .6 |

The above data indicates that the polybutene-amine-glycolic acid reaction product is superior as an antifouling agent to the polybutene additive of U.S. Pat. No. 4,200,518.

What is claimed is:

1. A process for reducing heat exchanger fouling in which a liquid hydrocarbon stream is passed through a heat exchanger at a temperature from 0° to 1500° F. wherein from 1 to 500 parts per million of an antifouling additive is added to said hydrocarbon stream, said additive comprising the reaction product of a polyalkylene amine and a hydroxy fatty acid, said polyalkylene amine being of the formula:

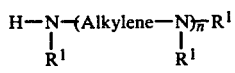

wherein n is an integer of at least 1 and less than 10 and each $R^1$ independently represents hydrogen or a substantially saturated hydrocarbon radical.

2. The process of claim 1 wherein said stream is crude oil.

3. The process of claim 1 wherein said hydroxy fatty acid contains 2 to 5 carbon atoms and is selected from glycolic acid, 2-hydroxy propionic acid, 1-hydroxy propionic acid, or 1-hydroxy butanoic acid.

4. The process of claim 3 wherein said hydroxy fatty acid is glycolic acid.

5. The process of claim 1 wherein 5 to 99 parts per million of said additive are added to said stream.

6. The process of claim 1 wherein said hydrocarbon stream is passed through said heat exchanger at a temperature from 50° to 500° F.

7. The process of claim 5 wherein said polyalkylene amine has a molecular weight in the range of 220 to 2,700 and said polyalkylene amine is a polybutene amine.

8. The process of claim 7 wherein said heat exchanger is a shell and tube heat exchanger.

9. A process for reducing heat exchanger fouling in which a liquid hydrocarbon stream is passed through a heat exchanger at a temperature from 0° to 1500° F. wherein from 1 to 500 parts per million of an antifouling additive is added to said hydrocarbon stream, said additive comprising a mixture of amides and imidazolines of the formula:

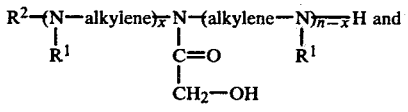

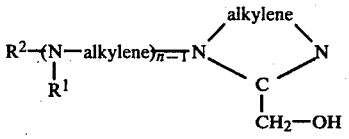

wherein $R^1$ represents hydrogen, methyl, or ethyl;
n is an integer from 1 to 9
$R^2$ is a polyalkylene group and
x is an integer from 0 to n−1.

* * * * *